US005163814A

United States Patent [19]

Hutter et al.

[11] Patent Number: 5,163,814

[45] Date of Patent: Nov. 17, 1992

[54] PORTABLE ELECTRIC FAN ASSEMBLY

[75] Inventors: Frank Hutter, Shallow Lake; Hans Heidolph, Wiarton; Michael Tettenborn, Kemble, all of Canada

[73] Assignee: Caframo Limited, Canada

[21] Appl. No.: 535,465

[22] Filed: Jun. 8, 1990

[30] Foreign Application Priority Data

Jun. 9, 1989 [CA] Canada ..... 602339

[51] Int. Cl.[5] ..... F04D 25/10

[52] U.S. Cl. ..... 416/100; 416/170 R; 416/235; 416/240; 416/246

[58] Field of Search ..... 416/100, 170 R, 170 C, 416/223 R, 240, 244 R, 246, 247 R, 235; 415/146

[56] References Cited

U.S. PATENT DOCUMENTS

| | | | |
|---|---|---|---|
| 769,676 | 8/1904 | Bachtel | 416/100 |
| 780,740 | 1/1905 | Bachtel | 416/100 |
| 871,672 | 11/1907 | Campbell | 416/100 |
| 1,442,467 | 1/1923 | Chernesky | 416/170 C |
| 1,676,467 | 7/1928 | Stuart | 416/100 |
| 2,050,764 | 8/1936 | Rogers | 416/100 |
| 3,901,625 | 8/1975 | Witzel | 416/240 R |
| 4,045,147 | 8/1977 | Curp | 416/100 |
| 4,251,189 | 2/1981 | Zinsser et al. | 416/240 R |

FOREIGN PATENT DOCUMENTS

| | | | |
|---|---|---|---|
| 1023852 | 2/1958 | Fed. Rep. of Germany | 416/100 |
| 116093 | 6/1986 | Japan | 415/146 |
| 2214232 | 8/1989 | United Kingdom | 416/170 R |

*Primary Examiner*—Edward K. Look
*Assistant Examiner*—James A. Larson
*Attorney, Agent, or Firm*—Eckert Seamans Cherin & Mellott

[57] ABSTRACT

A portable electric fan assembly for indoor use includes a base member, an upright electric motor mounted in the base member, an upstanding neck extending from the base member, a substantially vertical drive shaft couple to the motor extending within the upstanding neck, a fan head assembly carried by the neck and having at least a part thereof mounted for limited angular movement so as to be settable at a desired orientation, a fan blade shaft carrying a ban blade protruding forwardly from the movable part of the fan head assembly, and a coupling arrangement for drivably coupling the fan blade shaft to the drive shaft. The coupling arrangement includes a pair of bevelled wheels in mutual frictional engagement in the fan head assembly and mounted on respective input and output shafts disposed substantially at right angles to each other and having a fixed relative orientation to the bevelled wheels, thereby transferring mainly vertical drive motion to mainly horizontal drive motion, and a flexible coupling to accommodate the limited angular movement between the frame head and the neck.

2 Claims, 5 Drawing Sheets

Figure 1B:
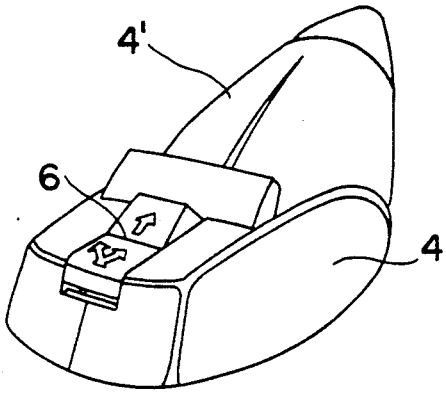

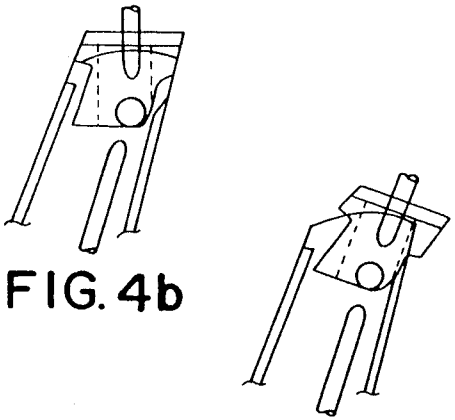
FIG. 4c
FIG. 4b
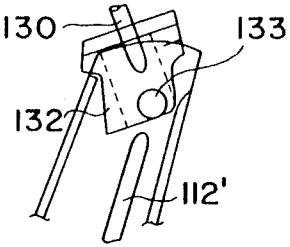
FIG. 4a
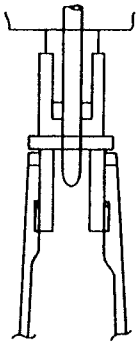
FIG. 4d
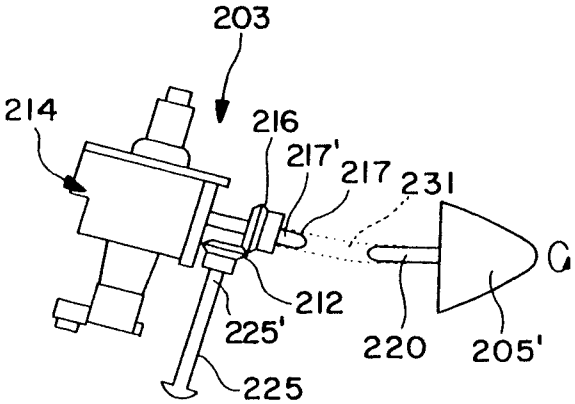
FIG. 5
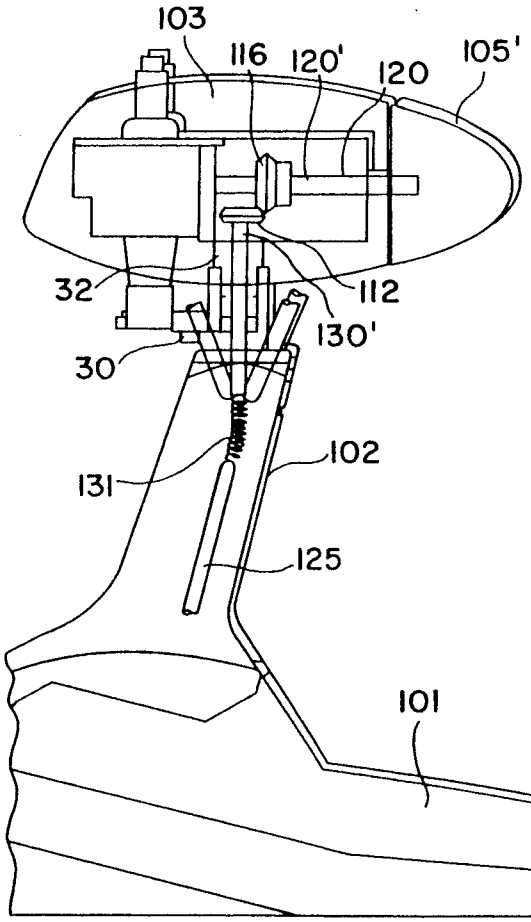
FIG. 4

PORTABLE ELECTRIC FAN ASSEMBLY

This invention relates to a portable electric fan assembly of the type intended for use in the home, offices and the like.

Such an electric fan assembly conventionally comprises a fan blade assembly mounted directly on the drive shaft of an electric motor contained within a fan head mounted on a stand. This construction has a number of disadvantages: The fan head has to be sufficiently large to accommodate the electric motor. The assembly as a whole has a high centre of gravity which results in inherent instability. And there is generally insufficient room for a gear box, which means that the fan has to be driven at a speed dictated by the motor when such a speed is not necessarily the optimum speed for fan performance.

The invention is particularly concerned with unguarded fan assemblies, and in this case the stability of the fan assembly is of utmost importance as it is clearly undesirable for a spinning fan to topple over even though the fan is designed for optimum safety.

An object of the invention is to alleviate the aforementioned problems of the prior art.

A portable electric fan assembly for indoor use, comprising a base member, an upright electric motor mounted within said base member, an upstanding neck extending from the base member, a substantially vertical drive shaft coupled to said motor extending within said upstanding neck, a fan head assembly carried by said neck and having at least a part hereof mounted for limited angular movement in the vertical plane so as to be settable at a desired orientation, a fan blade shaft carrying a fan blade protruding forwardly from said movable part of said fan head assembly; and coupling means for drivably coupling said fan blade shaft to said drive shaft, said coupling means comprising a pair of bevelled wheels in mutual frictional engagement in said fan head assembly and mounted on respective input and output shafts disposed substantially at right angles to each other and a fixed relative orientation to said beveled wheels thereby transferring mainly vertical drive motion to mainly horizontal drive motion, and a flexible coupling to accommodate the limited angular movement between the frame head and said neck.

By mounting the motor in the base of the assembly it is possible to lower the centre of gravity and thereby substantially increase the stability of the assembly. Furthermore, the head can be made much smaller and yet still accommodate a reduction mechanism to drive the fan blade assembly at the optimum speed for maximum efficiency.

The head is articulated such that it can be tilted in the vertical plane, with the driving connection being maintained between the drive shaft and the fan blade shaft. This is achieved either by employing a single set of bevel which in conjunction with a flexible coupling in the form of a spring connection.

The sets of meshing bevelled wheels are preferably in the form of a rubber friction drive in which each of the bevels forming said sets is made of rubber and the coupling between the two bevels is by friction. This provides for a silent operation of the coupling.

The head can consist of two parts, one fixed and one articulated, or a single part directly articulated to the top of the neck.

In addition, a commercially available oscillating mechanism can be coupled to the fan blade shaft to provide lateral oscillation of the head.

Figure 1A:
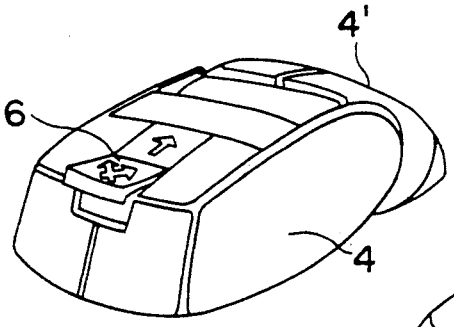
Figure 1:
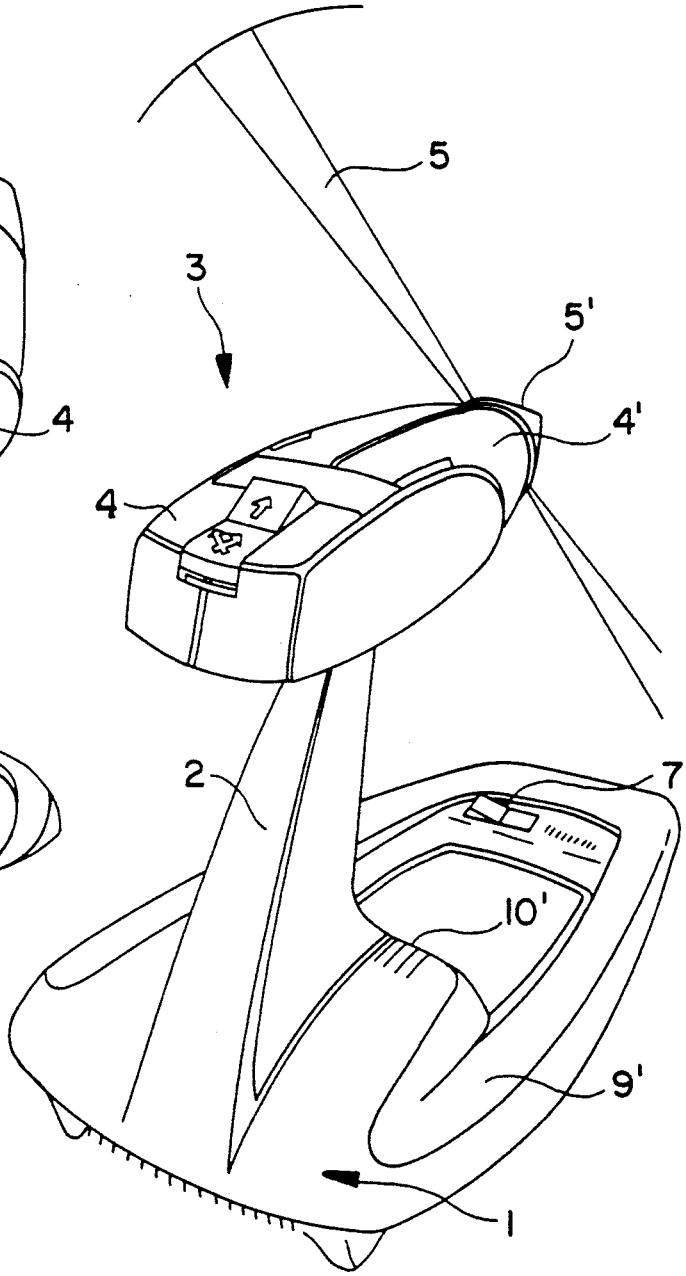
Figure 2:
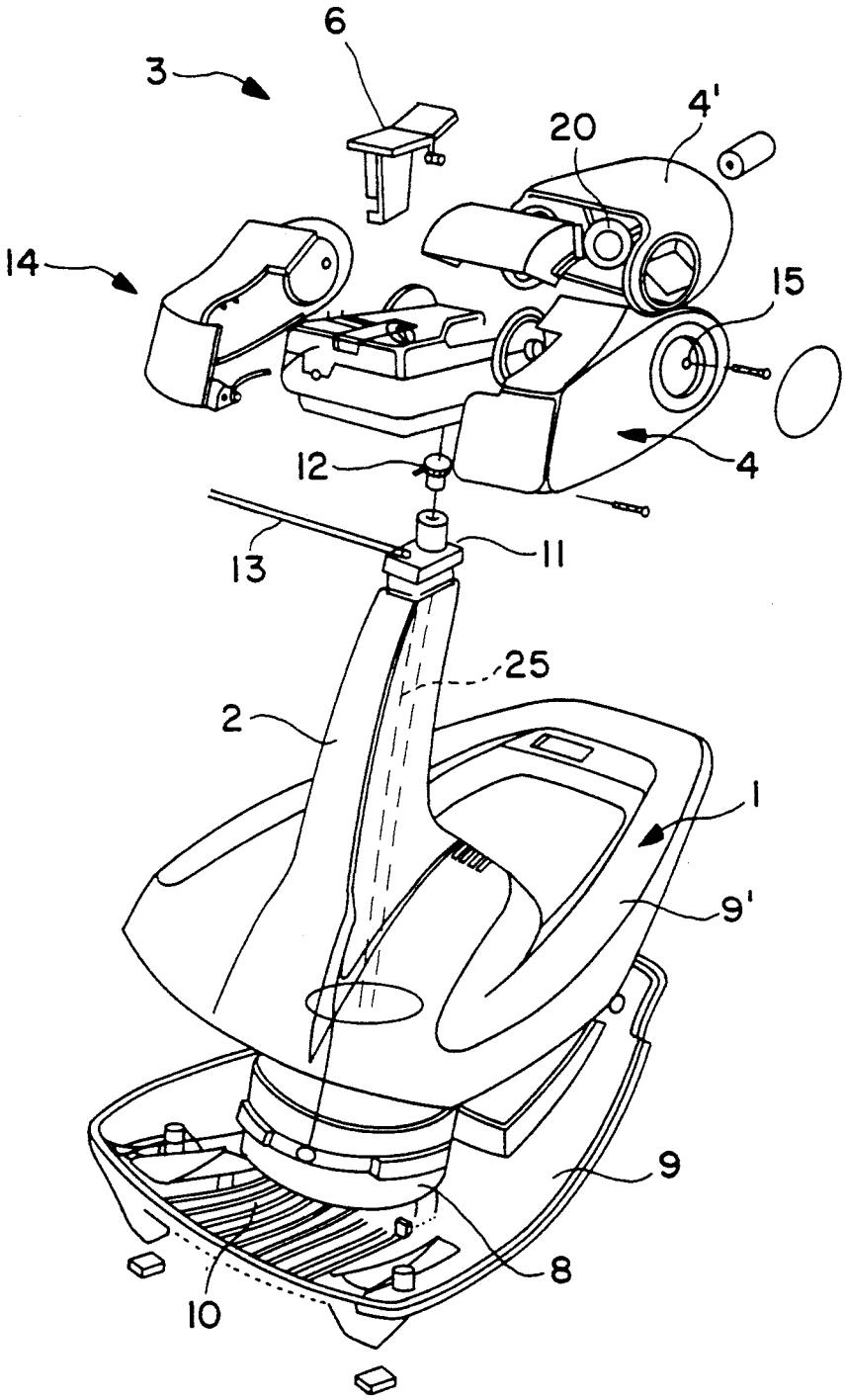
Figure 3B:
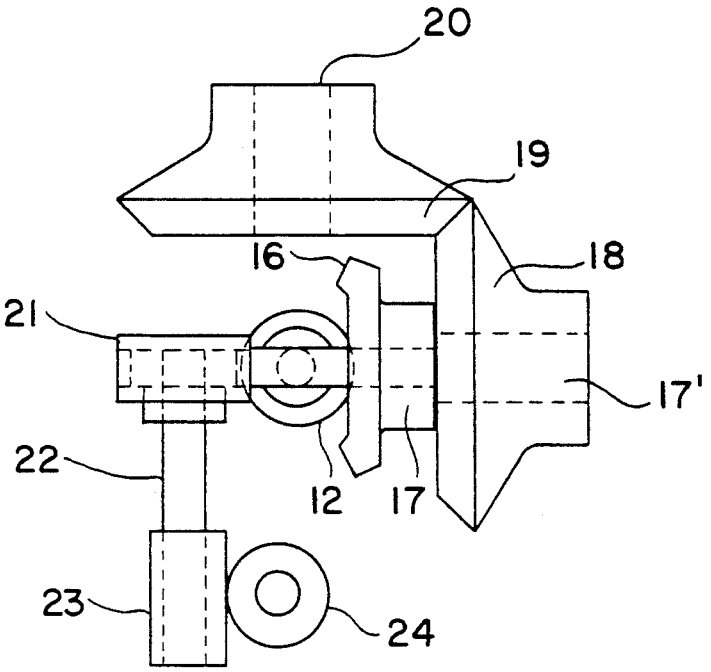
Figure 3B:
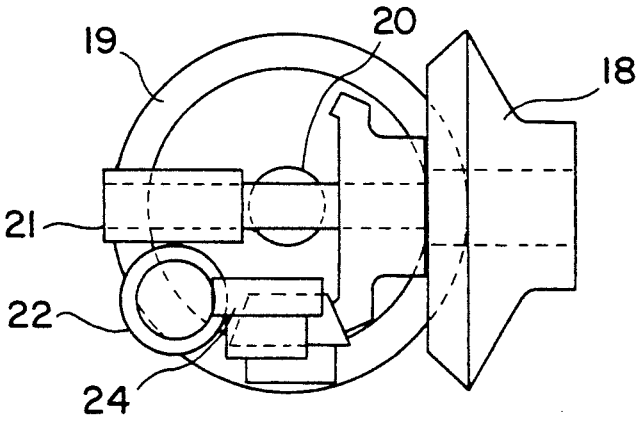

The invention will now be described in more detail, by way of example only, with reference to the accompanying drawings, in which:

FIG. 1 is a perspective view of a fan assembly in accordance with the invention;

FIGS. 1*a* and 1*b* show the head with the articulated member in different positions;

FIG. 2 is an exploded perspective view of the fan assembly;

FIG. 3*a* is a plan view of the gear mechanism in the assembly head;

FIG. 3*b* is a side elevation of the gear mechanism shown in FIG. 3*a;*

Figure 6:
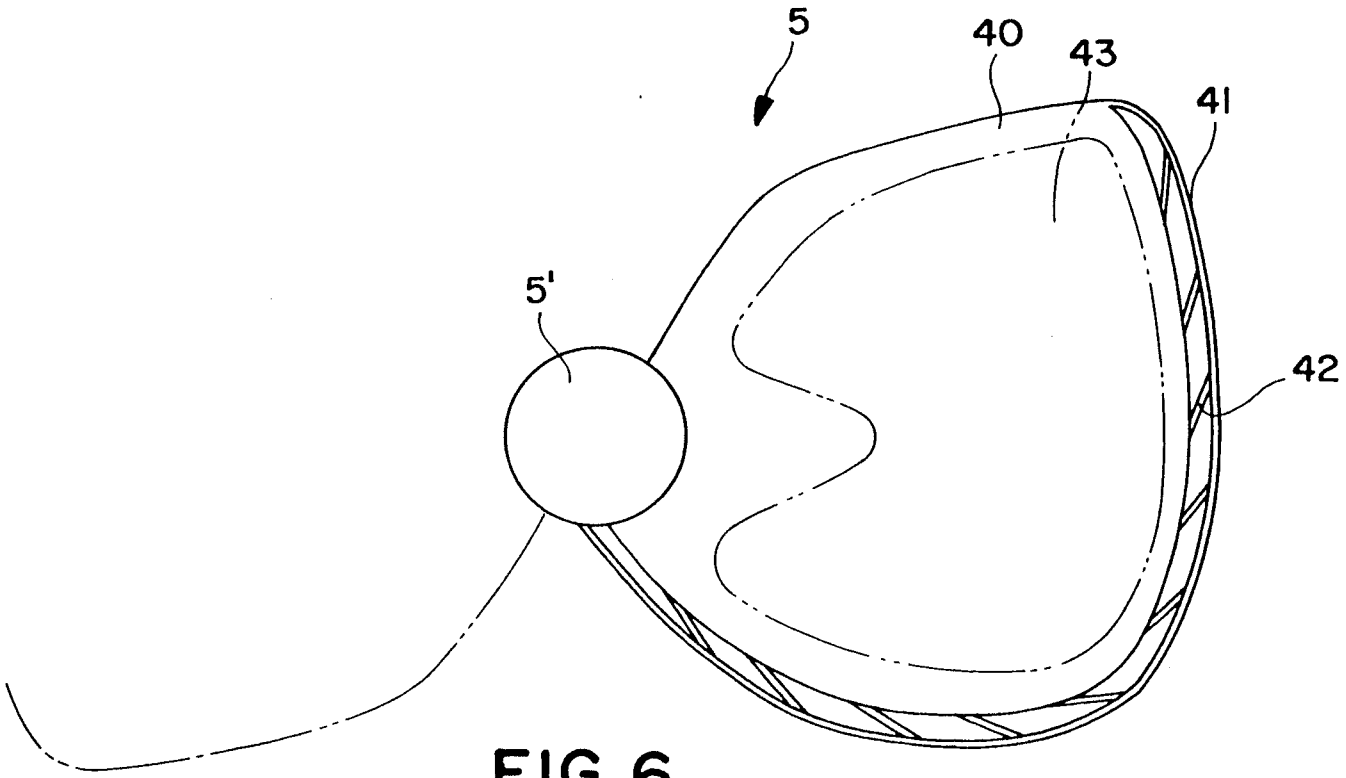

FIG. 4 is a side view of a second embodiment of a fan assembly in accordance with the invention;

FIGS. 4*a* to 4*d* illustrate the joint connecting the head to the neck in different positions;

FIG. 5 shows an alternative coupling arrangement for the fan blade shaft; and FIG. 6 is a front view of the fan assembly.

The portable fan assembly is molded of fire retardant A.B.S. plastic and comprises a base 1, a streamlined upstanding neck 2, and a head 3 mounting a fan blade assembly 5.

The base 1 consists of a cover plate 9' cooperating with a bottom plate 9 to form a housing accommodating a shaded four pole type electric motor 8 rated at 120 volts and 60 Hertz, designed to run at a maximum of 1500 r.p.m.

The base plate 9 cover plate are provided with a slotted grill 10 for ventilation.

The electric motor 8 is bolted to the base plate 9 and can be isolated from the housing by means of rubber spacers (not shown).

The motor has a drive shaft 25 extending within the neck 2 and locating in a top bearing 11, where it is connected to a drive pinion in the form of bevel gear 12.

The bearing 11 is fixed to the neck 2 with self tapping screws, and if necessary the bearing can be secured after the motor has been mounted and while it is running so as to ensure proper alignment.

The base cover 9' also has a two pole three position switch 7 for controlling the motor in either one of two speeds or the off position.

The head 3 has a part 4 whose orientation is fixed in the vertical plane, but which is rotatably mounted on the top bearing 11. A second part 4' is articulated to the first part 4 about pivot axis 15 to permit tilting in the vertical plane. The part 4, is designed to tilt about 30 degrees above the vertical and 10 degrees below it. The part 4' contains a fan blade shaft 20 connected to a fan blade assembly 5 and terminated by a hub 5'.

FIGS. 1*a* and 1*b* show the part 4' in opposed tilted positions to permit the air flow directed at the desired angle.

The head 3 also has a pivot button 6 for engagement and disengagement of an oscillating mechanism 14. The mechanism 14 is of a type which is commercially available and upon engagement causes rotational oscillation of the part 4 in the horizontal plane at a desired rate, such as four cycles per minute. The mechanism 14 has an eccentric arm 13 connected between the head part 4 and the top bearing 11.

As shown in FIGS. 3*a* and 3*b*, the head 3 accommodates two sets of engaged bevel gears 12, 16 and 18, 19.

All the gears are molded from glass reinforced nylon with a Molybdenum sulfide lubricant. The gear box, gears, top bearing and output shaft bearing are molded on one family tree.

The gear 12 is directly connected to the motor 8 through the drive shaft 25. The gear 12 transmits power to the gear 16, which is mounted on an intermediate shaft 17 connected to an extension shaft 17' carrying bevel gear 18, which is larger than the gear 16 and in engagement with bevel gear 19 mounted on the fan blade shaft 20. The bevel gears 12, 16 give a 1 to 1.5 reduction ratio such that the speed of the motor will be approximately 1,000 rpm, which has been found to be the optimum for maximum efficiency.

The arrangement of bevel gears 18, 19 allows power to be continuously transmitted to the fan blade shaft 20 while the orientation of the part 4' is changed.

Worm gear 21 takes off power from the intermediate shaft 17 and transmits it through shaft 22, worm gear 23, and pinion gear 24 to the oscillating mechanism 14.

In an alternative embodiment shown in FIG. 4, the drive shaft 125 is mounted within the neck 102 extending upwardly from the base cover 101.

The fan head 103 is articulated in the vertical plane about pivot shaft 133 mounted in the top of the neck 102 by means of lug 132. The head 103 contains a single set of bevel 112, 116, the bevel gear 116 being mounted on an end portion 120' of the fan blade shaft, 120 and oscillating mechanism 114. The bevel gear 112 is mounted on an end portion 130' of intermediate shaft 130, which is connected to the drive shaft 125 through a spring coupling 131, which maintains the driving connection between the drive shaft 125 and the intermediate shaft 130 as the fan head 103 is tilted in the vertical plane. The gears 112, 116 provide the 1 to 1.5 reduction ratio for optimum performance of the fan blade assembly 5.

FIG. 5 shows an alternative embodiment for the two-part head of the type shown in FIGS. 1 and 2. The part of the head that is fixed in the vertical plane contains the bevel gear 212 mounted on an end portion 225' of drive shaft 225 extending through the neck to the electric motor. Bevel gear 216 is mounted on an end portion of intermediate shaft 217 connected to the oscillating mechanism 214 and the fan blade shaft 220 by means of a spring coupling 231. The fan blade shaft 220 carries hub 205'.

In this embodiment, the gears 212, 216 provide the 1 to 1.5 reduction ratio and the spring coupling 231 permits the tilting movement of the vertically moveable part of the head 203.

In a particularly desirable embodiment of the invention the meshing gears 12 and 16 in FIGS. 3*a* and 3*b* and the meshing gears 112 and 116 in FIG. 4 and the meshing gears 212 and 216 in FIG. 5 are replaced by similar bevelled members which rely on a friction coupling suitably rubber bevelled members which form a rubber friction drive. This makes for essentially silent operation of the coupling.

Referring to FIG. 6, the fan blade assembly has a diameter of 10½ inches, mass of 48 grams, and is made of polyethylene. Each blade has a built up zone 40 around the periphery of the blade and a central zone 43 covering the major part of the blade of reduced thickness (nominal thickness 0.020 inches). The leading edge is of the fan blade carries a resilient bead 41 spaced therefrom by means of angularly offset spacing ribs 42 of approximately 0.050 inches thickness, variable according to the design stiffness of the protective bead 41. The blades are more cupped than usual, resulting in the air being concentrated into a more narrow channel. The blade assembly can operation at speeds up to 1070 rpm while remaining below the maximum permissible kinetic energy factor of 2 for unguarded fans. At this speed, the fan blade assembly can deliver twice the air volume of a conventional blade assembly operating at a speed of 2000 rpm.

A digital speed control can be added to the base 1, and furthermore a removeable insert can be advantageously mounted in the base cover 9' to permit alterations to incorporate speed control switches, electronic timer, and other desirable options.

The described fan is highly stable, compact and efficient producing a high volume air flow while remaining safe in the event of a person accidently being struck by the fan blade assembly.

The embodiments of the invention in which an exclusive property or privilege is claimed are defined as follows:

1. A portable electric fan assembly for indoor use, comprising a base member, an upright electric motor mounted within said base member, an upstanding neck extending from the base member, a substantially vertical drive shaft coupled for rotation by said motor and extending within said upstanding neck, a fan head assembly carried by said neck and having at least a part thereof mounted for limited angular movement in the vertical plane so as to be settable at a desired orientation, a fan blade shaft carrying fan blade means protruding forwardly from said movable part of said fan head assembly; and coupling means for drivably coupling said fan blade shaft to said drive shaft, said coupling means comprising a pair of bevelled wheels in mutual frictional engagement in said fan head assembly and coupled between the drive shaft and the fan blade shaft, the bevelled wheels being disposed substantially at right angles to each other and at a fixed relative orientation, thereby transferring mainly vertical drive motion to mainly horizontal drive motion, and a flexible coupling to accommodate the limited angular movement between the fan head assembly and said neck, and wherein said flexible coupling is mounted drivingly in said neck between said fan blade shaft and said drive shaft.

2. A portable electric fan assembly for indoor use, comprising a base member, an upright electric motor mounted within said base member, an upstanding neck extending from the base member, a substantially vertical drive shaft coupled for rotation by said motor and extending within said upstanding neck, a fan head assembly carried by said neck and having at least a part thereof mounted for limited angular movement in the vertical plane so as to be settable at a desired orientation, a fan blade shaft carrying fan blade means protruding forwardly from said movable part of said fan head assembly; and coupling means for drivably coupling said fan blade shaft to said drive shaft, said coupling means comprising a pair of bevelled wheels in mutual frictional engagement in said fan head assembly and coupled between the drive shaft and the fan blade shaft, the bevelled wheels being disposed substantially at right angles to each other and at a fixed relative orientation, thereby transferring mainly vertical drive motion to mainly horizontal drive motion, and a flexible coupling to accommodate the limited angular movement between the fan head assembly and said neck, and wherein the whole of said fan head assembly is articulated to the top of said neck.

* * * * *